US008505845B2

(12) United States Patent
Zink

(10) Patent No.: US 8,505,845 B2
(45) **Date of Patent: *Aug. 13, 2013**

(54) SYSTEM AND METHOD FOR STORING, ROTATING, AND FEEDING A HIGH PRESSURE HOSE

(75) Inventor: Gerald P. Zink, Durango, CO (US)

(73) Assignee: Stoneage, Inc., Durango, CO (US)

( * ) Notice: Subject to any disclaimer, the term of this patent is extended or adjusted under 35 U.S.C. 154(b) by 546 days.

This patent is subject to a terminal disclaimer.

(21) Appl. No.: 12/846,531

(22) Filed: Jul. 29, 2010

(65) Prior Publication Data

US 2012/0025002 A1 Feb. 2, 2012

(51) Int. Cl.
*B65H 19/30* (2006.01)

(52) U.S. Cl.
USPC ..... 242/533.8; 242/390.3

(58) Field of Classification Search
USPC ..... 232/533, 533.3, 533.8, 390, 390.2, 232/390.3
See application file for complete search history.

(56) References Cited

U.S. PATENT DOCUMENTS

| | | | | |
|---|---|---|---|---|
| 3,025,547 | A * | 3/1962 | Ciaccio | 15/104.33 |
| 3,394,422 | A | 7/1968 | Siegal | |
| 3,928,885 | A * | 12/1975 | Peterson et al. | 15/104.33 |
| 4,144,898 | A | 3/1979 | Guignon et al. | |
| 4,540,017 | A * | 9/1985 | Prange | 137/355.12 |
| 4,832,074 | A | 5/1989 | Li | |
| 5,184,636 | A | 2/1993 | van der Woude | |
| 5,322,080 | A | 6/1994 | Rankin | |
| 5,323,797 | A * | 6/1994 | Rankin | 134/167 C |
| 5,397,057 | A | 3/1995 | Verstraeten | |
| 5,862,561 | A * | 1/1999 | Irwin | 15/104.33 |
| 6,360,757 | B1 | 3/2002 | Bohrer | |
| 7,040,331 | B2 | 5/2006 | Garman et al. | |
| 7,178,534 | B2 | 2/2007 | Garman et al. | |
| 7,530,363 | B2 | 5/2009 | Garman | |
| 2009/0211044 | A1 | 8/2009 | Hale et al. | |

FOREIGN PATENT DOCUMENTS

| | | |
|---|---|---|
| DE | 4211146 | 10/1993 |
| JP | 3059390 | 3/1991 |
| WO | 02059538 | 8/2002 |
| WO | 2005032725 | 4/2005 |

* cited by examiner

*Primary Examiner* — William A Rivera
(74) *Attorney, Agent, or Firm* — Greenberg Traurig, LLP

(57) ABSTRACT

A system for storing, rotating and feeding a high pressure hose. A first portion of the hose is disposable about the drum and a guide arm engages a second portion of the hose. An actuator assembly rotates a cage and the guide arm so that the guide arm rotates relative to the cage such that the hose is rotated. Relative rotation in one direction causes the first portion of the hose to uncoil from the drum and displace along the guide arm and causes a third portion of the high pressure hose in an output port to displace out of the output port away from the guide arm. Relative rotation in an opposite direction causes the second portion of the high pressure hose to coil about the drum and causes the third portion of the high pressure hose to displace into the housing.

23 Claims, 9 Drawing Sheets

SYSTEM AND METHOD FOR STORING, ROTATING, AND FEEDING A HIGH PRESSURE HOSE

FIELD OF THE INVENTION

The present disclosure relates generally to a system and method for storing, rotating, and feeding a high pressure hose. In particular, the present disclosure relates to system and method for storing, rotating, and feeding a high pressure hose using a cage and a guide arm independently rotatable with respect to each other using an actuator assembly, and an independently rotatable drum about which the hose is wrapped.

BACKGROUND OF THE INVENTION

U.S. Pat. Nos. 7,530,363; 7,178,534; and 7,040,331 (Garman, Daniel T. or Garman et al.) teach a hose held in a rotating frame and the use of pinch wheels to grip and axially displace the hose.

U.S. Pat. No. 5,322,080 (Rankin, George J.) WO 2002/059538 (Vanhatalo, Timo) each teach a two-piece assembly for rotating and axially displacing a hose. A hose is rotated by a first unit and a separate unit presses on the hose to axially translate the hose. There is no reserve of hose feed out of the first unit, so the axial displacement requires that the first unit be dragged by the hose toward a device into which the hose is being fed.

SUMMARY OF THE INVENTION

According to aspects illustrated herein, there is provided a system for storing, rotating and feeding a high pressure hose, including: a housing including an output port; a rotatable cylindrically-shaped cage disposed within the housing; a rotatable cylindrically-shaped drum disposed within the cage; a rotatable guide arm disposed within the cage; and an actuator assembly for rotating the cage and the guide arm. An end of a high pressure hose is connectable to the cage; a first portion of the high pressure hose is disposable about the drum; and the guide arm is for engaging a second portion of the high pressure hose. The actuator assembly is for rotating the cage and the guide arm so that the guide arm rotates relative to the cage such that: the second portion of the high pressure hose is rotated about a longitudinal axis for the hose; relative rotation of the guide arm with respect to the cage in a first rotational direction causes the first portion of the high pressure hose to uncoil from the drum and displace along the guide arm and causes a third portion of the high pressure hose in the output port to displace out of the output port away from the guide arm; and relative rotation of the guide arm with respect to the cage in a second rotational direction, opposite the first rotational direction, causes the second portion of the high pressure hose to coil about the drum and causes the third portion of the high pressure hose to displace into the housing.

According to aspects illustrated herein, there is provided a system for storing, rotating and feeding a high pressure hose, including: a housing including an output port; a rotatable cylindrically-shaped cage disposed within the housing; a rotatable guide arm disposed within the cage and including a plurality of idler rollers forming a guide path; and an actuator assembly for rotating the cage and the guide arm. A first end of a high pressure hose is connectable to the cage; and the guide arm is for engaging a portion of the high pressure hose in the guide path. The actuator assembly is for rotating the cage and the guide arm, respectively, so that the guide arm rotates relative to the cage such that: the portion of the high pressure hose is rotated about a longitudinal axis for the hose; relative rotation of the guide arm with respect to the cage in a first rotational direction causes the plurality of idler rollers to urge the portion of the high pressure hose toward the output port; and relative rotation of the guide arm with respect to the cage in a second rotational direction, opposite the first rotational direction, causes the plurality of idler rollers to urge the portion of the high pressure hose away from the output port.

According to aspects illustrated herein, there is provided a system for storing, rotating and feeding a high pressure hose, including: a housing with an output port; a rotatable guide arm including a plurality of idler rollers forming a guide path; a rotatable drum; and an actuator assembly for rotating the guide arm. The drum is free to rotate relative to the guide arm; the plurality of idler rollers is for engaging a first portion of a high pressure hose in the guide path; and a second portion of the high pressure hose is disposable about the drum. The actuator assembly is for rotating the guide arm relative to the cage such that: the first portion of the high pressure hose is rotated about a longitudinal axis for the hose; relative rotation of the guide arm with respect to the drum in a first rotational direction causes the plurality of idler rollers to urge the second portion of the high pressure hose into the guide path and to urge a third portion of the high pressure hose through the output port out of the housing; and relative rotation of the guide arm with respect to the drum in a second rotational direction, opposite the first rotational direction, causes the plurality of idler rollers to wrap the first portion of the high pressure hose about the drum and to urge the third portion of the high pressure hose through the output port into the housing.

According to aspects illustrated herein, there is provided a method for storing, rotating and feeding a high pressure hose, including: rotating a cylindrically-shaped cage disposed within a housing for a system; and rotating a guide arm disposed within the cage such that the guide arm rotates relative to the cage. In response to the relative rotation of the guide arm and the cage, the method includes: rotating a first portion of a high pressure hose, engaged with the guide arm, about a longitudinal axis for the hose, wherein an end of the high pressure hose is fixed to the cage; for relative rotation of the guide arm and the cage in a first rotational direction, uncoiling a third portion of the high pressure hose from about the drum, displacing the third portion of the high pressure hose through the guide arm, and displacing a second portion of the high pressure hose through an outlet port in the housing and out of the housing; and for relative rotation of the guide arm and the cage in a second rotational direction, opposite the first rotational direction, coiling the first portion of the high pressure hose about a rotatable drum and displacing the second portion of the high pressure hose through the outlet port and into the housing.

According to aspects illustrated herein, there is provided a method for storing, rotating and feeding a high pressure hose, including: rotating a cylindrically-shaped cage within a housing; and rotating a guide arm, disposed within the cage, such that the guide arm rotates relative to the cage, the guide arm including a plurality of idler rollers forming a guide path. In response to the relative rotation of the guide arm and the cage, the method includes: rotating a portion of a high pressure hose, disposed in the guide path, about a longitudinal axis for the hose, wherein one end of the hose is connected to the cage; for relative rotation of the guide arm with respect to the cage in a first rotational direction, urging, with the plurality of idler rollers, the portion of the high pressure hose toward an output port in the housing; and for relative rotation of the guide arm with respect to the cage in a second rotational direction, opposite the first rotational direction, urging, with the plurality of idler rollers, the portion of the high pressure hose away from the output port.

According to aspects illustrated herein, there is provided a method for storing, rotating and feeding a high pressure hose, including: engaging a first portion of a high pressure hose in a guide path formed by a plurality of idler rollers on a guide arm located in a housing; disposing a second portion of the high pressure hose about a rotatable drum within the housing; and rotating the guide arm so that the guide arm and the drum rotate at first and second rates, respectively, the first rate greater than the second rate. In response to the relative rotation of the guide arm and the drum, the method includes: rotating the first portion of the high pressure hose about a longitudinal axis for the hose; for relative rotation of the guide arm with respect to the drum in a first rotational direction, urging, via the plurality of idler rollers, the second portion of the high pressure hose into the guide path and urging a third portion of the high pressure hose through an output port out of the housing; and for relative rotation of the guide arm with respect to the drum in a second rotational direction, opposite the first rotational direction, wrapping, via the plurality of idler rollers, the first portion of the high pressure hose about the drum and urging the third portion of the high pressure hose through the output port into the housing.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE PREFERRED EMBODIMENT

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

It should be understood that the use of "or" in the present application is with respect to a "non-exclusive" arrangement, unless stated otherwise. For example, when saying that "item x is A or B," it is understood that this can mean one of the following: 1) item x is only one or the other of A and B; and 2) item x is both A and B. Alternately stated, the word "or" is not used to define an "exclusive or" arrangement. For example, an "exclusive or" arrangement for the statement "item x is A or B" would require that x can be only one of A and B.

Figure 1A:
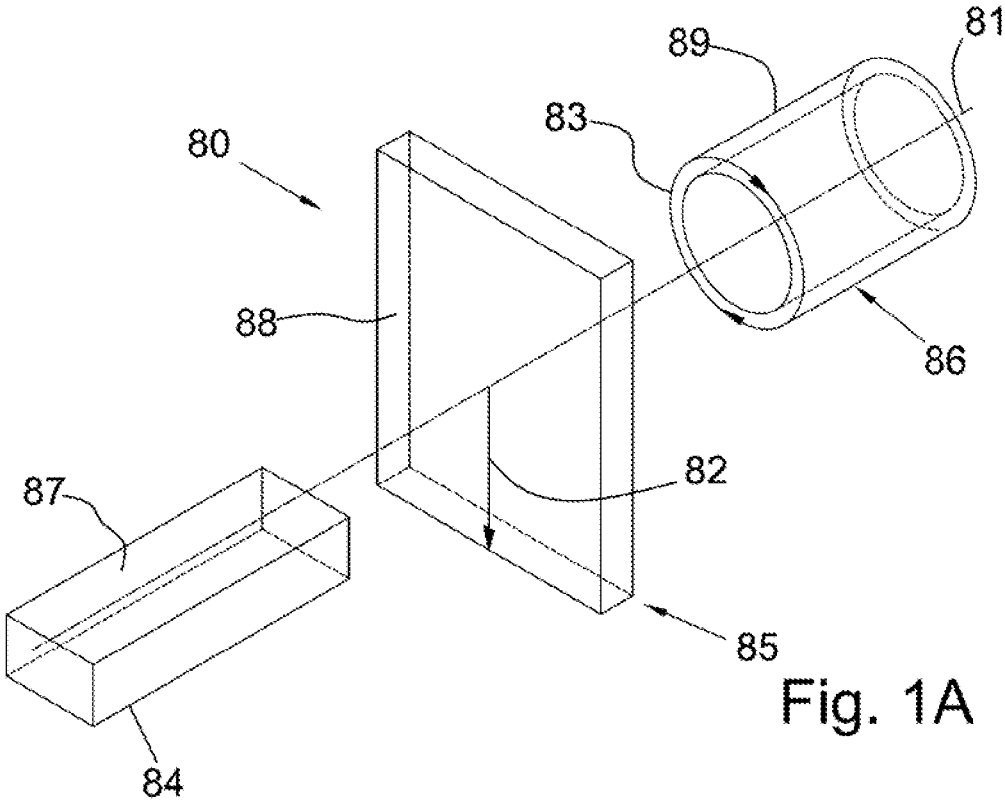
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential surface. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
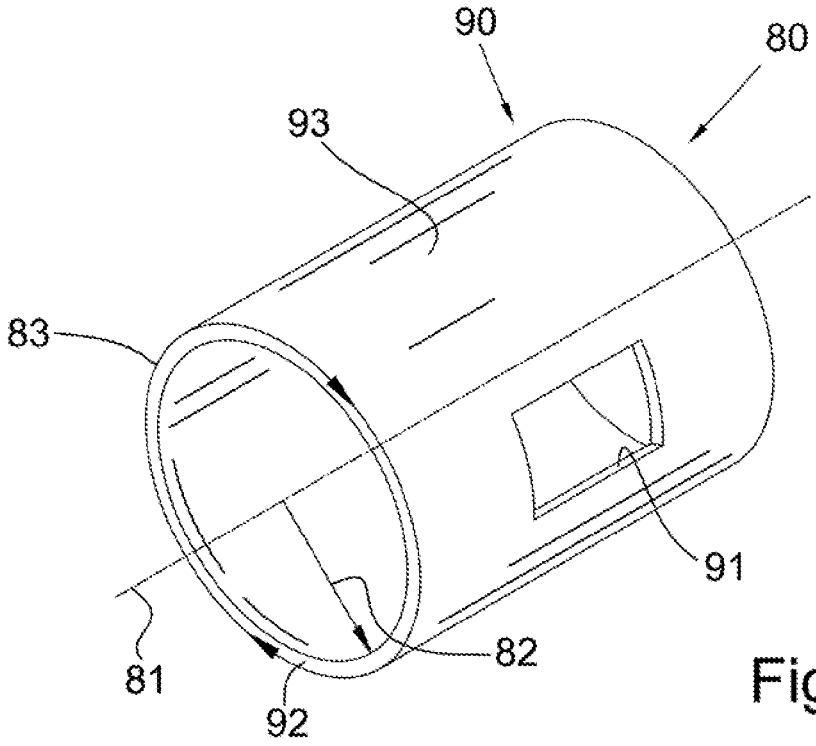
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present disclosure in any manner. Object 90 includes axial surface 91, radial surface 92, and circumferential surface 93. Surface 91 is part of an axial plane, surface 92 is part of a radial plane, and surface 93 is part of a circumferential surface.

Figure 2:
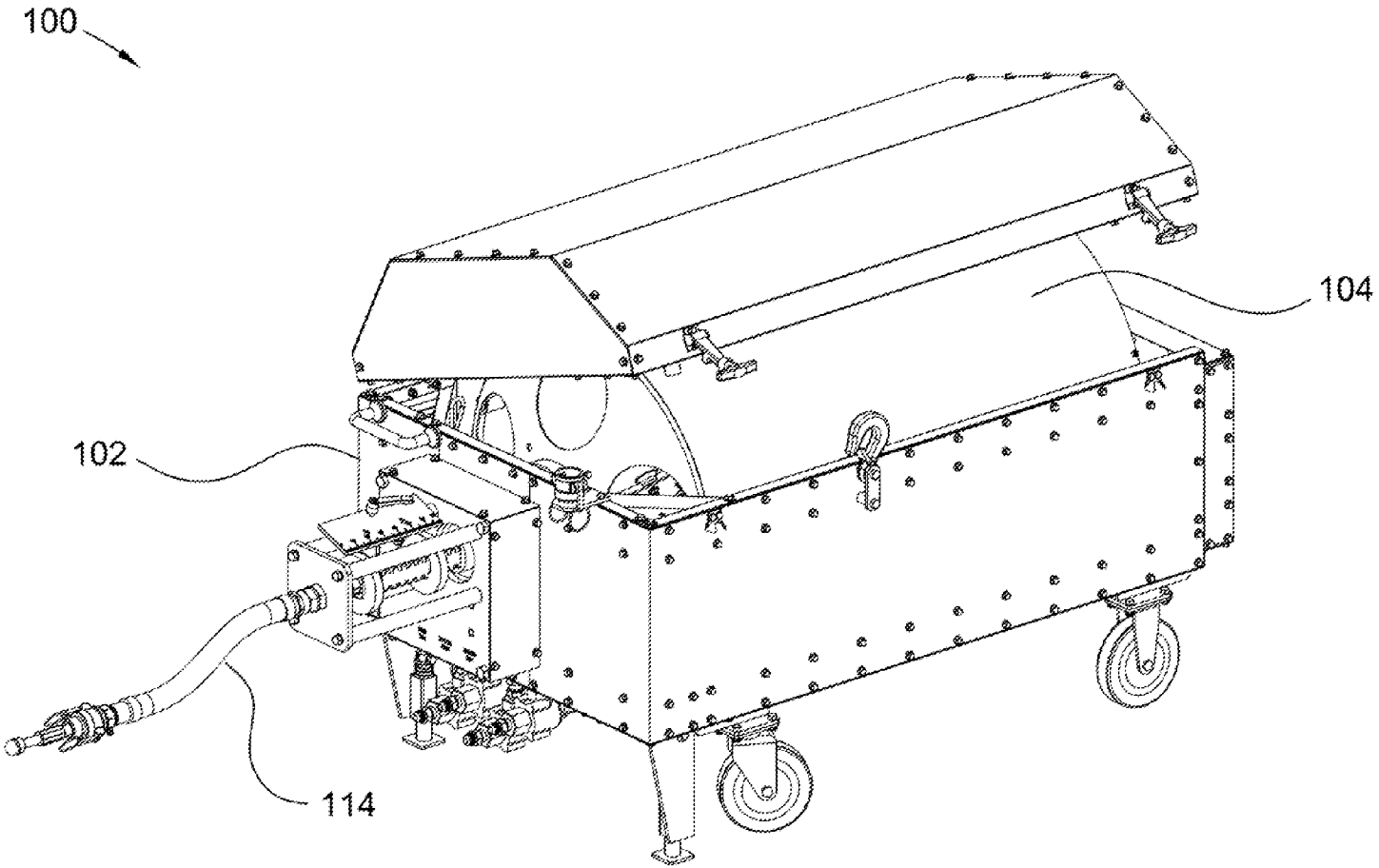
FIG. 2 is a side perspective view of a system for storing, rotating and feeding a high pressure hose, with a housing cover partially lifted.

FIG. 2 is a side perspective view of system 100 for storing, rotating and feeding a high pressure hose with a housing cover partially lifted.

Figure 3:
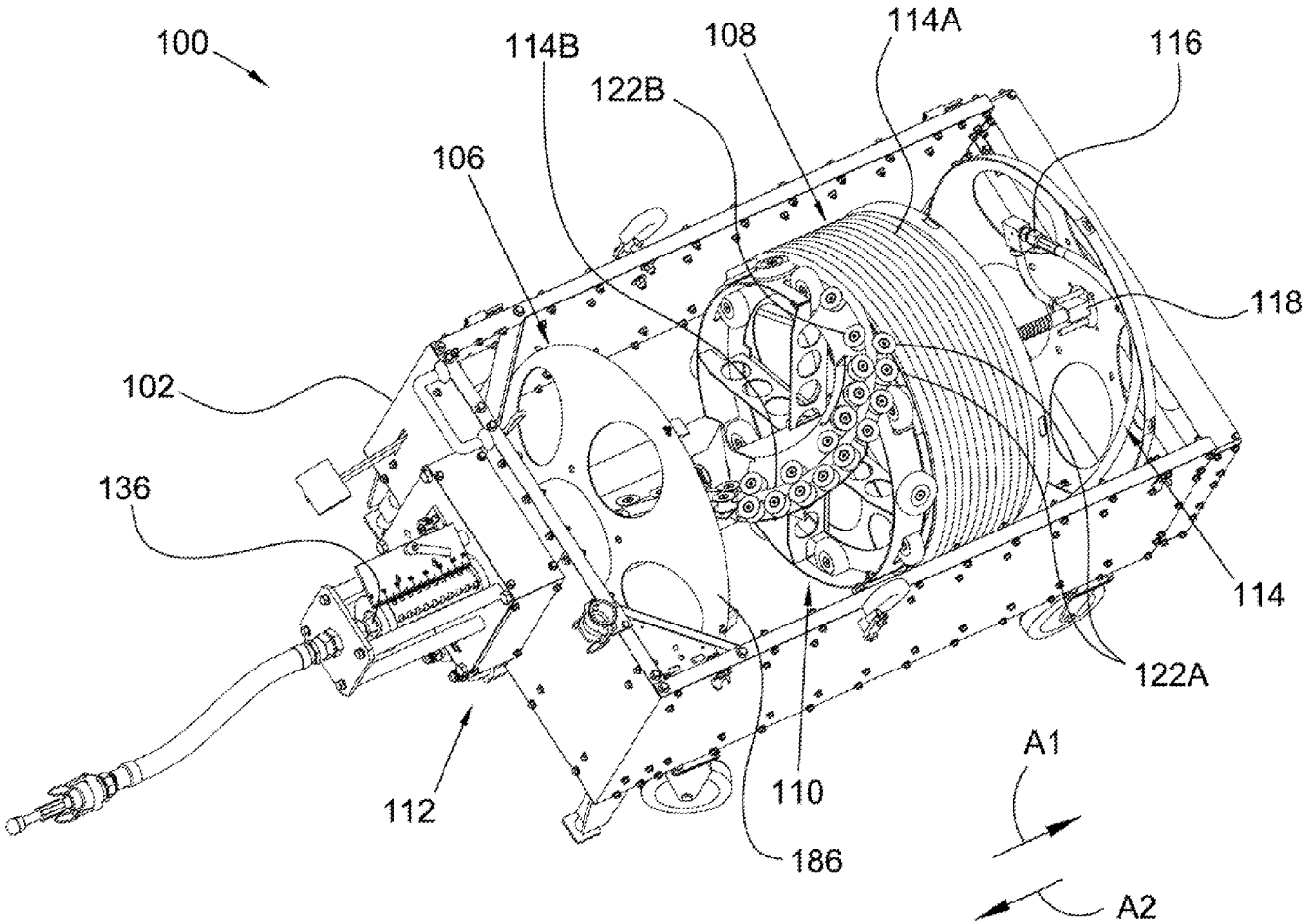
FIG. 3 is a plan perspective view of the system shown in FIG. 2, with the housing cover removed and a cage partially removed.

FIG. 3 is a plan perspective view of system 100 shown in FIG. 2 with the housing cover removed and a sleeve partially removed.

Figure 4:
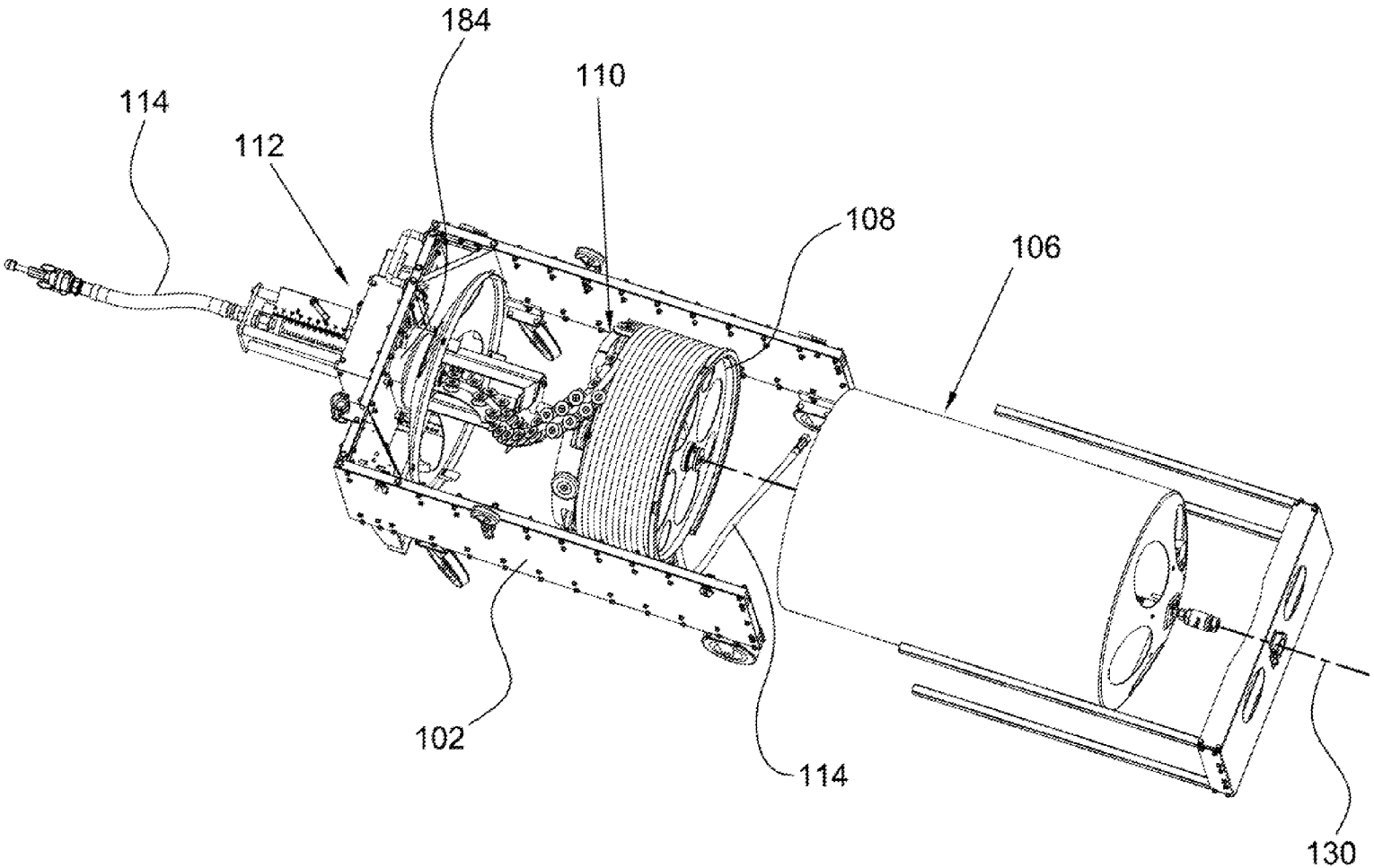
FIG. 4 is a perspective exploded view of the system shown in FIG. 2, with the housing cover removed.

FIG. 4 is a perspective exploded view of system 100 shown in FIG. 2 with the housing cover removed.

Figure 5:
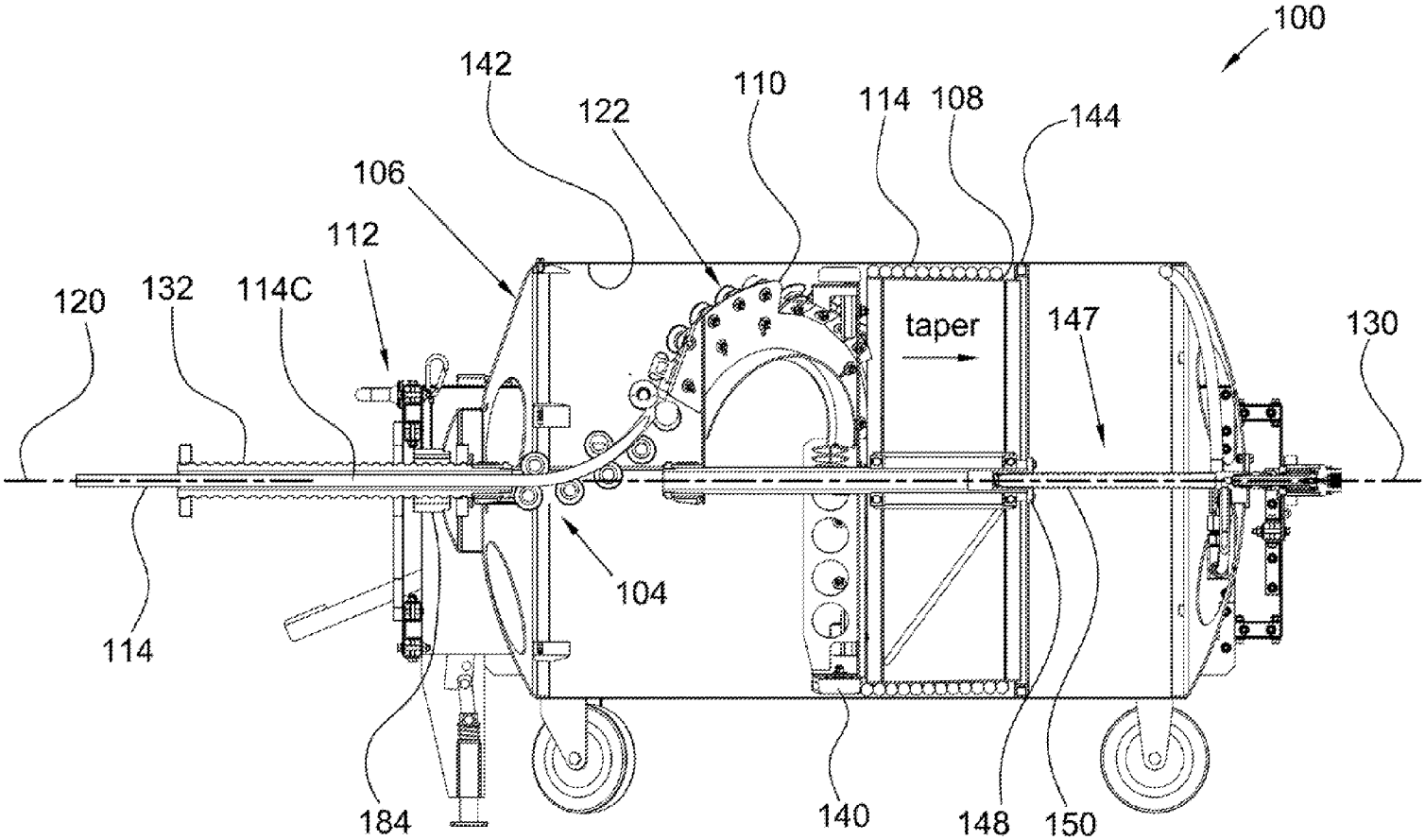
FIG. 5 is a cross-sectional view of the system shown in FIG. 2, generally along an axis of rotation for the cage.

FIG. 5 is a cross-sectional view of system 100 shown in FIG. 2, generally along an axis of rotation for the cage.

Figure 6:
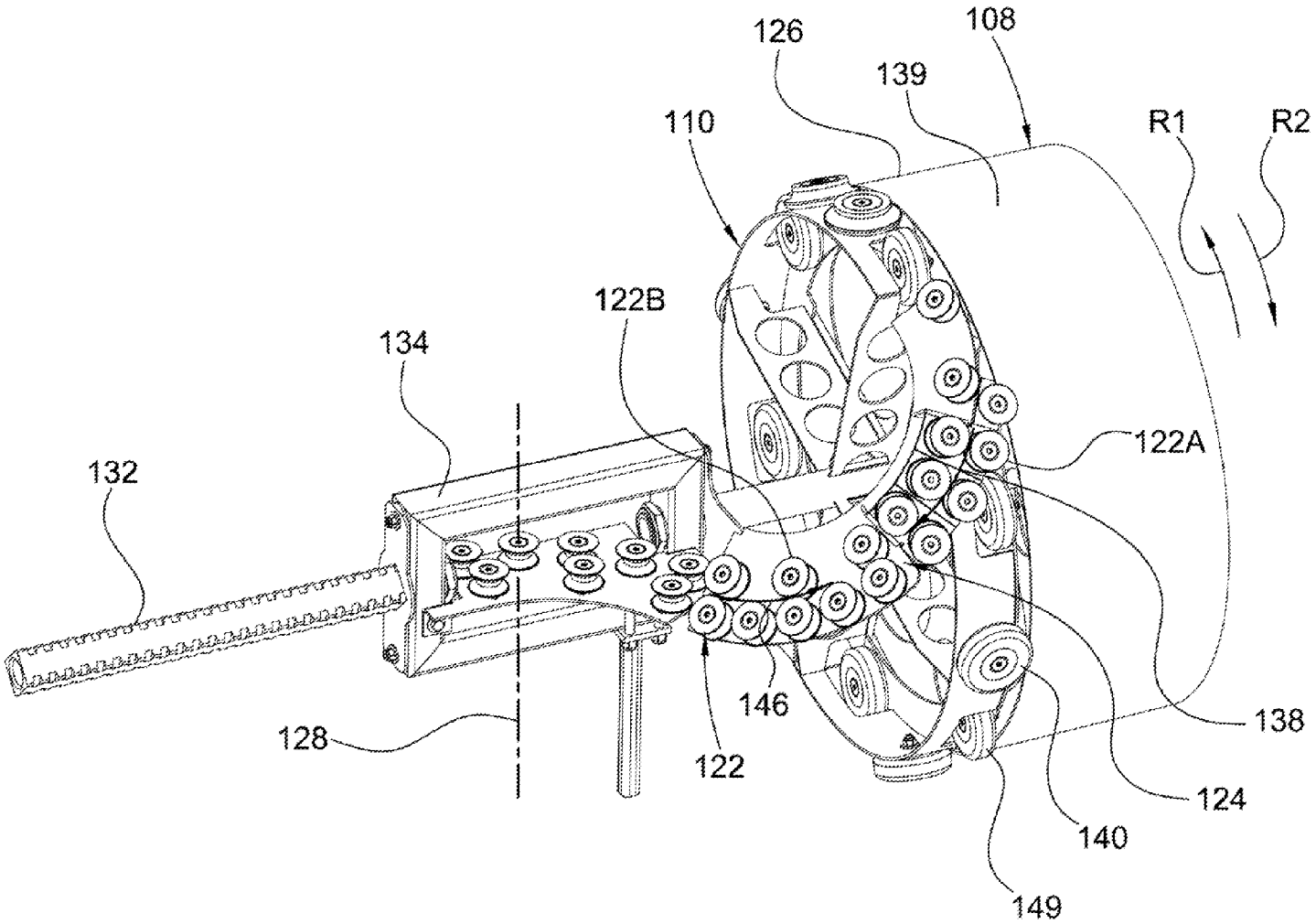
FIG. 6 is a detail of the system shown in FIG. 2, showing a guide arm and drum with the hose removed.

FIG. 6 is a detail of system 100 shown in FIG. 2 showing a guide arm and drum with the hose removed. The following should be viewed in light of FIGS. 2 through 6. System 100 includes housing 102 with output port 104; rotatable cylindrically-shaped cage 106 disposed within the housing; rotatable cylindrically-shaped drum 108 disposed within the cage; and rotatable guide arm 110 disposed within the cage. The system also includes actuator assembly 112 for rotating the cage and the guide arm. High pressure hose 114 is included in the description that follows to illustrate the function of system 100. It should be understood that although system 100 is designed for use with a high pressure hose, the hose itself is not necessarily part of system 100. In one embodiment, system 100 includes hose 114. In one embodiment, system 100 does not include hose 114.

In one embodiment, end 116 of the hose is fixedly connected to the cage, for example, via swivel connection 118. That is, end 116 rotates with the cage. Portion 114A of the hose is disposed about the drum. The guide arm engages portion 114B of the high pressure hose. The actuator assembly rotates the cage and the guide arm, respectively, so that portion 114B is rotated about longitudinal axis 120 for the hose, as further described infra. Portions of the hose downstream of portion 114B, for example, portion 114C, also are rotated about axis 120. Thus, the hose rotates, but does not translate, or feed. Hereinafter, the terms "translate" and "feed" are used interchangeably.

In one embodiment, relative rotation of the guide arm with respect to the cage in rotational direction R1 causes portion 114B to displace through the guide arm toward the output port, causing portion 114A to unwind from the coil into the guide arm. In addition, the displacement of portion 114B causes the downstream portions of the hose to feed toward the output port. For example, portion 114C of the hose displaces out of the housing through the output port. In one embodiment, relative rotation of the guide arm with respect to the cage, for example, in rotational direction R2, causes portion 114B to displace through the guide arm and to coil about the drum. In addition, the displacement of portion 114B causes the downstream portions of the hose to retract toward the drum. For example, portion 114C of the hose displaces into the housing through the output port. Thus, the hose both rotates and feeds.

In one embodiment, the guide arm includes plurality of idler rollers 122 forming curved guide path 124 from approximately outer circumference 126 of the drum to the output port. That is, the rollers form the edges of the guide path. Portion 114B of the high pressure hose is disposed in the guide path. By idler rollers, we mean that the rollers are not connected to an actuator to supply rotational energy to the rollers. That is, the rollers freely turn when not engaged and rotate only in response to energy applied by an outside element to respective outer circumferences of the rollers. In one embodiment, a respective position for axis of rotation 128 for each idler roller is fixable with respect to the guide arm. For example, during operation of the system to rotate or feed the hose, the idler rollers do not move to more tightly engage, or squeeze, the hose. It should be understood that the positions of the idler rollers may be adjustable, for example, to accommodate different diameter hoses. However, after such adjustments, the axes of the rollers remain fixed in the adjusted positions.

In one embodiment, port 104 is co-axial with axis of rotation 130 for the cage, the guide arm, and the drum. Hollow drive shaft 132 extends through the port and at one end is connected to bridge element 134. The guide arm feeds into the bridge element and tube 136 co-axial with axis 128 and located inside drive shaft 132. That is, the guide path extends to the bridge element and tube 136. As further described below, the bridge element is used to transmit torque to the guide arm while enabling shaft 132 and tube 136 to be co-axial with axis 130.

The interaction of the guide arm, in particular, rollers 122, with the hose causes the translation of the hose described above. Drum 108 is axially fixed with respect to the guide arm, but is rotationally independent of both the drum and the cage. That is, the drum is free to rotate about axis 130.

For relative rotation of the guide arm with the cage in the R1 direction, the guide arm rotates in the R1 direction with respect to the drum and rollers 122A of rollers 122, located on one side of the guide path, urge the hose in direction 138. The rollers direct the hose along the guide path. That is, the hose reacts to the urging by displacing in direction 138, thereby causing downstream portions of the hose, such as portion 114C, to feed away from the drum.

The urging of rollers 122A causes portion 114B to expand radially outward. To ensure that the reaction of the hose is channeled in direction 138, the portions of the hose still disposed about the drum are restrained from moving in any direction other than through the guide path. In one embodiment, rollers 140 restrain portion 114B from movement in axial direction A2, inner surface 142 of the cage restrains portion 114B from further movement in a radially outward direction, and protrusion, or stop, 144, extending radially inward from surface 142, restrains portion 114B from movement in direction A1. In one embodiment, the radially outward movement of the hose minimizes or eliminates contact between the hose and outer circumference 139 of the drum. Thus, the only unrestrained direction available for portion 114B is 138.

For relative rotation of the guide arm with the cage in the R2 direction, the guide arm rotates in the R2 direction with respect to the drum and rollers 122B of rollers 122, located on the other side of the guide path from rollers 122A, urge the hose in direction 146, coiling portion 114A about the drum. That is, the hose reacts to the urging by displacing in direction 146 and downstream portions of the hose, such as portion 114C feed toward the drum. The urging of rollers 122B causes the hose to displace radially inward. To ensure that the reaction of the hose is channeled in direction 146, the portions of the hose disposed about the drum and being coiled about the drum are restrained from moving in any direction other than through the guide path to a desired position on the drum. In one embodiment, rollers 140 restrain portion 114B from movement in axial direction A2, outer circumference 139 restrains portion 114B radially inward, and protrusion, or stop, 144, restrains portion 114B from movement in direction A1. Thus, the only unrestrained direction for portion 114B is 146.

Advantageously, rollers 122 urge the hose to translate without crushing, gripping, or squeezing the hose, all of which can damage the hose. For example, the rollers on one side of the guide path merely push the hose. Further, the axial displacement of the hose does not require the hose to drag housing 102 toward a device into which the hose is being fed. Such a dragging motion puts a severe strain on the hose and results in damage to the hose.

To restrain the hose, for example, portion 114B, as the hose is peeled from the drum by the guide arm or coiled about the drum by the guide arm, the guide arm and the drum axially displace in response to the relative motion of the guide arm and the cage. For example, for relative motion of the guide arm in direction R1, the guide arm and drum displace in direction A1 so that stop 144, which is stationary with respect to the axial movement, acts to push portion 114B in direction A2, keeping rollers 140 in contact with portion 114B as the hose is peeled off. The drum slides under stop 144 in direction A1. As noted above, in this mode, the hose has little or no contact with the drum and stop 144 acts to push portion 114B toward the guide arm. When the hose has been uncoiled to the maximum extent, the drum is in a position furthest in direction A1.

For relative motion of the guide arm in direction R2, the guide arm and drum displace in direction A2 so that stop 144, which is stationary with respect to the axial movement, acts to restrain portion 114B in direction A1, keeping rollers 140 in contact with portion 114B as successive portions of the hose are coiled about the drum. Thus, the drum slides under stop 144 in direction A2. In one embodiment, the drum is tapered in direction A1 to facilitate coiling of the hose. When the hose has been coiled to the maximum extent, the drum is in a position furthest in direction A2.

In one embodiment, system 100 includes assembly 147 for axial displacement of the guide arm and drum. In one embodiment, assembly 147 includes female threaded component 148 connected to one end of the drum and co-linear with axis 130, and male threaded component 150 co-linear with axis 130, and having one first end matingly engaged with the female threaded component and another end fixed to the cage. In one embodiment, components 148 and 150 are an Acme nut and thread, respectively. Assembly 147 is used to center and stabilize the guide arm and drum and to implement the axial displacement of the guide arm and drum described above. For example, due to the relative rotation between the guide arm and the cage, there is a differential rotation between the drum and the cage. Component 148 is rotationally fixed to the drum and thus rotates along with the drum. Component 150 is fixed to the cage and rotates with the cage. Therefore, as component 148 rotates with respect to component 150 due to the relative rotation of the drum and cage, component 148 translates along component 150 due to the threaded engagement of the two components. The direction of the translation depends on the direction of the relative rotation of the drum. In one embodiment, the pitch of component 150 is sized so that one rotation of the drum and component 148 with respect to the cage displaces the drum a distance in the axial directions equal to the diameter of hose 114. In one embodiment, rollers 149 contact inner surface 142 to radially center and stabilize the guide arm.

Figure 7:
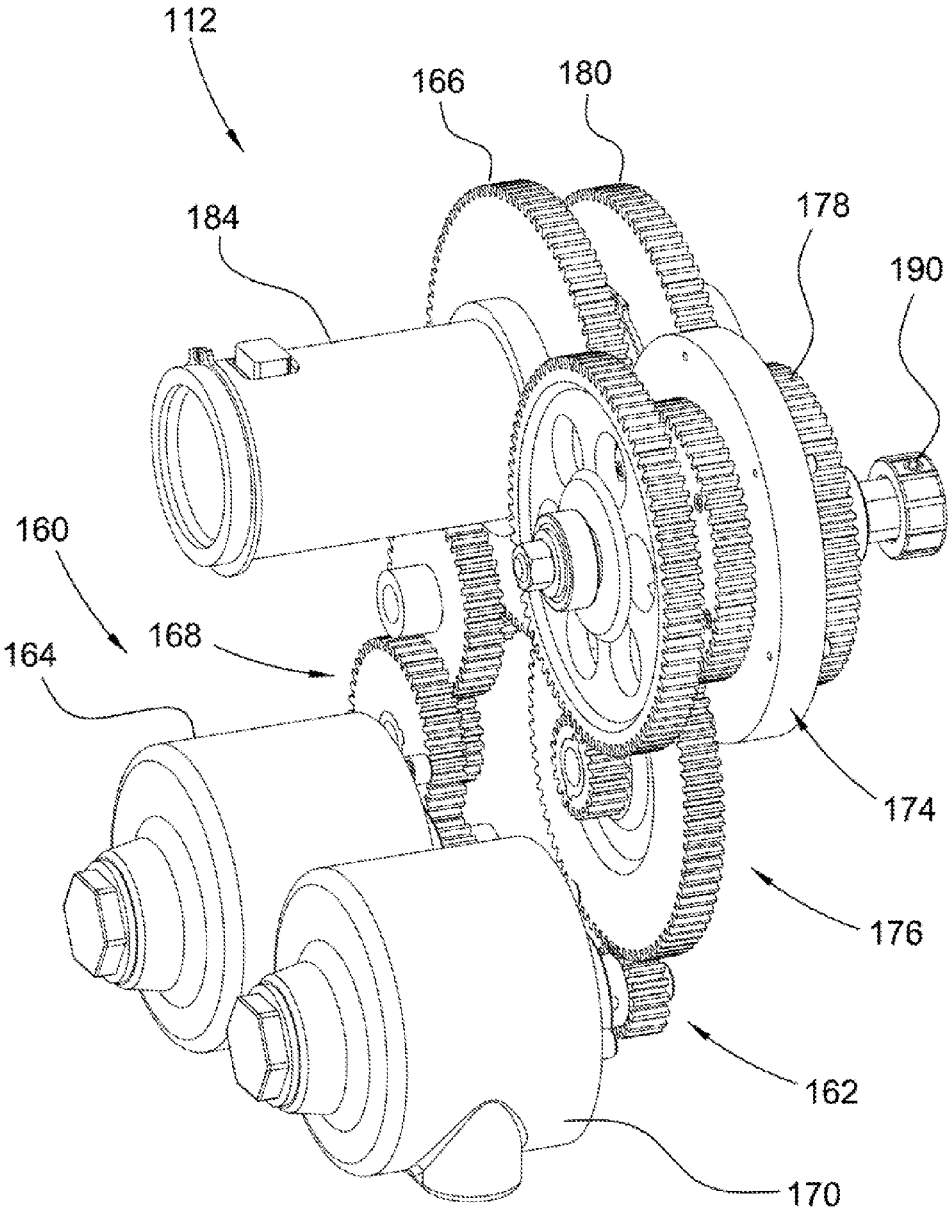
FIG. 7 is a perspective view of the actuator system shown in FIG. 2 with the casing removed.

FIG. 7 is a perspective view of the actuator system shown in FIG. 2 with the casing removed.

Figure 8:
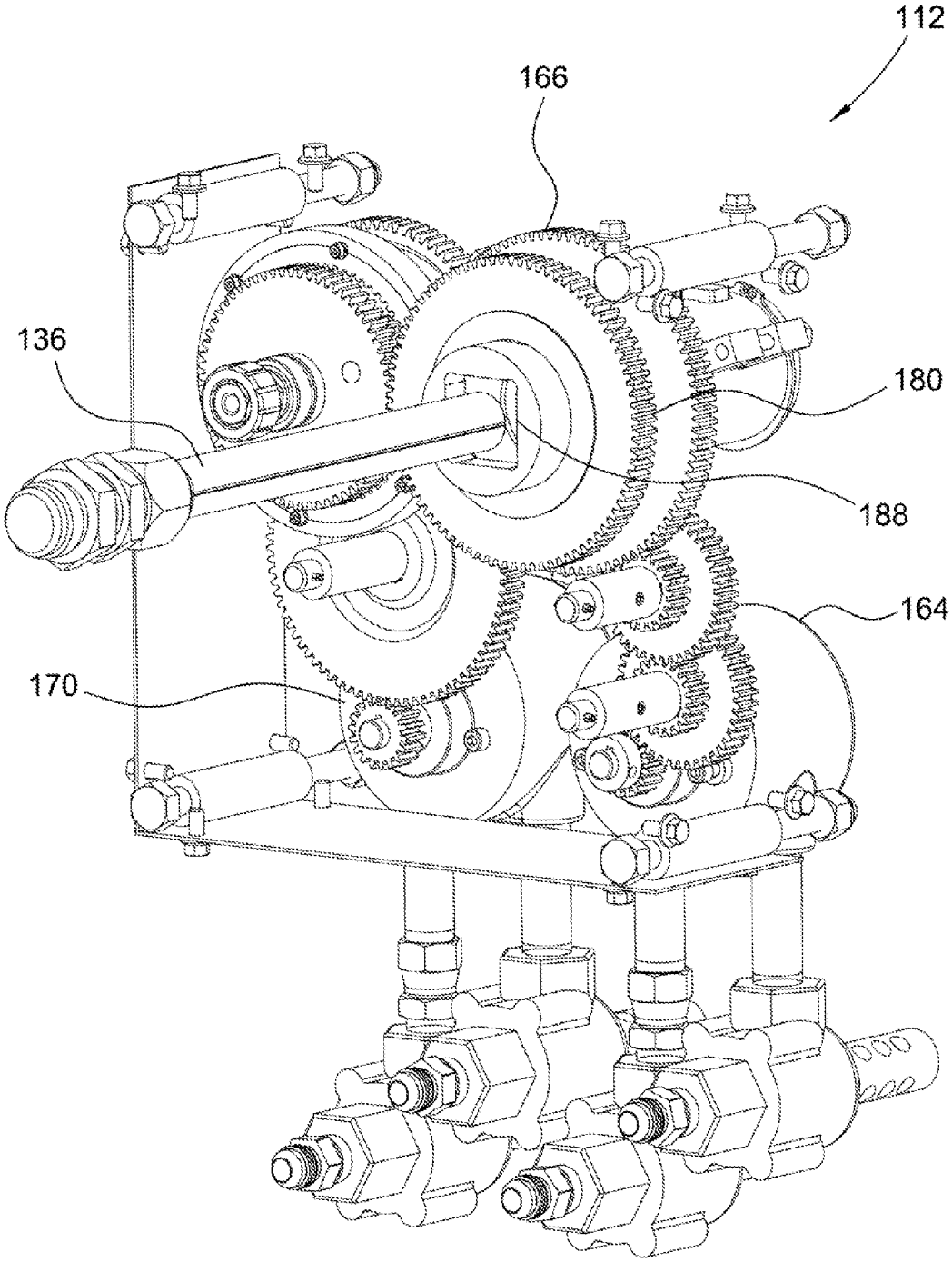
FIG. 8 is a perspective view of the actuator system shown in FIG. 2 viewed from the housing with the casing removed; and, FIG. 9 is a partial detail of the actuator system shown in FIG. 7 with a cut-away of the planetary gear.

FIG. 8 is a perspective view of the actuator system shown in FIG. 2 viewed from the housing with the casing removed.

Figure 9:
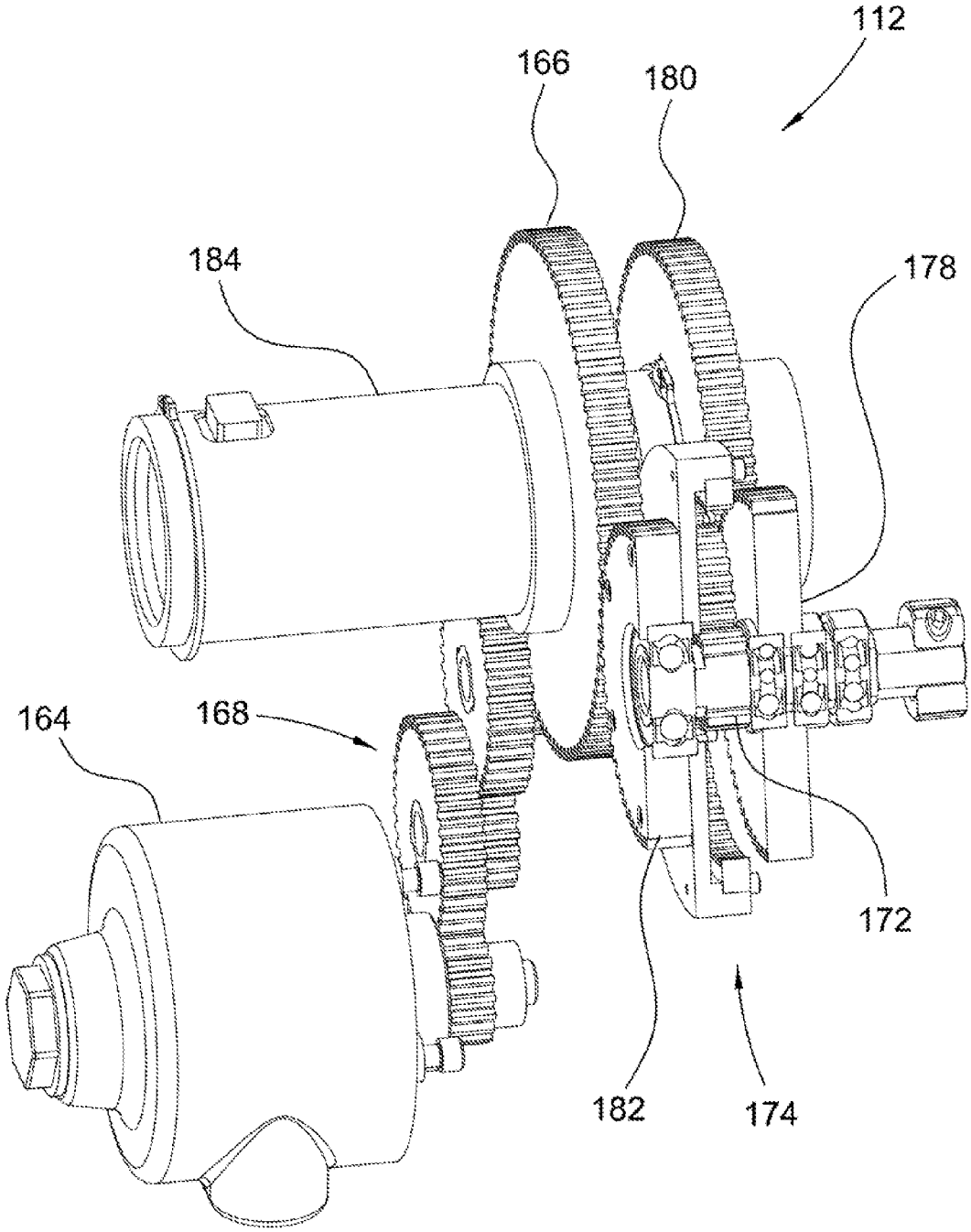

FIG. 9 is a partial detail of the actuator system shown in FIG. 7 with a cut-away of the planetary gear set. The following should be viewed in light of FIGS. 2-9. The following is an exemplary embodiment of an actuator assembly, or system, for system 100. It should be understood that types and combinations of components other than those shown and described are possible. Actuator system 112 includes cage actuation assembly 160 and feed actuation assembly 162. In one embodiment, the cage assembly includes motor 164 connected to cage drive gear 166 via plurality of reduction gears 168. In one embodiment, there are four gears 168. In one embodiment, the feed assembly includes motor 170 connected to sun gear 172 of planetary gear set 174 via a plurality of reduction gears 176. Planet gears 178 are connected to feed drive gear 180. Drive gear 166 is connected to ring gear 182. The motors can be any type of motor known in the art. In one embodiment, the motors are pneumatic.

Drive gear 166 is connected to one end of cage drive shaft 184. The other end of the cage drive shaft is connected to end cap 186 of the cage. Thus, drive gear 166 rotates the cage via drive shaft 184. Drive gear 180 is connected to one end of drive shaft 132, for example, at interface 188, the other end of shaft 132 is connected to the bridge element. Drive shaft 132 and tube 136 are co-axial with shaft 184 and disposed within shaft 184. Thus, shaft 132 passes through drive gear 166 to connect to drive gear 180. Drive gear 180 rotates the guide arm via shaft 132 and the bridge element. Shafts 132 and 184 pass through output port 104. Tube 136 is disposed within shaft 132. The hose feeds through the tube.

To rotate and feed the hose, both motors are activated, or actuated. Hereinafter, the terms "active" and "actuate" and their derivatives are used interchangeably. Since motor 164 drives the ring gear via drive gear 166, and motor 170 drives the sun gear, the rotation of drive gear 180 depends on the ratio of rotation of the sun and ring gears. Thus, the rotation of gear 180, shaft 132, and the guide arm is controlled by both motors. Thus, rotation and feed of the hose is driven by two independent motors, each of which can be started, stopped, accelerated, or reversed independent of the other with selectable effects on the motion of the hose.

To rotate the guide arm in direction R1 with respect to the cage, both motors are driven in a forward direction. The rotational speed of drive gear 180, and hence the guide arm, depends on the respective rotational speeds of the sun gear and the ring gear, which is driven by gear 166. To rotate the guide arm in direction R2 with respect to the cage, motor 164 is driven in the forward direction and motor 170 is driven in a reverse direction. If motor 170 is driven at a high enough speed in the reverse direction, the guide arm rotates oppositely from the cage.

To rotate the hose without feed, motor 164 is activated and motor 170 is deactivated. Thus, the sun gear is inactive, and drive gears 166 and 180 are rotated at a same rate via gears 168 and ring gear 182, respectively.

To rotate the hose with a nominal feed, or creep, gears ratios in assembly 112 are configured such that when motor 164 is activated and motor 170 is deactivated, shaft 132 rotates slightly faster than shaft 184. In one embodiment, shaft 132 rotates 0.0036 revolutions faster than shaft 184, such that the hose creeps (advances or retracts) 0.10 inches per revolution of the guide arm. It should be understood that other creep rates are possible through other gear ratio configurations. In one embodiment, if the hose encounters sufficient resistance to creeping in either direction, and the sun gear is allowed to rotate freely, the creep feed terminates and the sun gear is driven backwards. In one embodiment, sun indicator 190 indicates the progress of a creep feed.

The following is a description of a method for storing, rotating and feeding a high pressure hose. Although the method is depicted as a sequence for clarity, no order should be inferred from the sequence unless explicitly stated. The following should be viewed in light of FIGS. 2-9. A first step rotates a cylindrically-shaped cage, such as cage 106, disposed within a housing, such as housing 102, for a system, such as system 100. A second step rotates a guide arm, such as guide arm 108, disposed within the cage such that the guide arm rotates relative to the cage. In response to the relative rotation of the guide arm and the cage: a fourth step rotates a first portion of a high pressure hose, engaged with the guide arm, about a longitudinal axis for the hose. An end of the high pressure hose is fixed to the cage; a fifth step, for relative rotation of the guide arm and the cage in a first rotational direction, uncoils a second portion of the high pressure hose from about the drum, displaces the second portion of the high pressure hose through the guide arm, and displaces a third portion of the high pressure hose through an outlet port in the housing, such as port 104, and out of the housing; and for relative rotation of the guide arm and the cage in a second rotational direction, opposite the first rotational direction, a sixth step coils the first portion of the high pressure hose about a rotatable drum and displaces the third portion of the high pressure hose through the outlet port and into the housing.

In one embodiment: one step rotates the cage and the guide arm at a same rotational rate; another step rotates the first portion of the high pressure hose about the longitudinal axis for the hose; and a further step fixes the third portion of the high pressure hose with respect to movement through the output port. In one embodiment, the guide arm includes a plurality of idler rollers, such as rollers 122, forming a curved guide path, such as path 124, from the drum to the output port; and the first portion of the high pressure hose is disposed in the guide path. The method includes, in response to the relative rotation of the guide arm and the cage, applying, by the plurality of idler rollers, a force to the first portion of the high pressure hose to displace the first portion of the high pressure hose through the guide path.

In one embodiment, the guide arm and the drum are axially fixed to each other and axially displaceable; the drum is free to rotate with respect to the guide arm; and rotating the guide arm with respect to the cage includes rotating the cage relative to the drum. The method includes displacing the guide arm and the drum in response to the relative rotation of the cage and the drum. In one embodiment, the guide arm includes a plurality of idler rollers, such as rollers 140, having respective axes substantially orthogonal to an axis of rotation for the guide arm and the cage and having respective outer circumferences substantially radially aligned with a second end of the drum; and the cage includes a radially inwardly facing surface, such as surface 142, including a radially inwardly facing protrusion, such as protrusion 144. The method includes using the plurality of idler rollers, the inwardly facing surface, and the inwardly facing protrusion to restrain the second portion of the high pressure hose as the guide arm rotates with respect to the cage.

In one embodiment, the system includes: a first drive shaft, such as shaft 184, for rotating the cage; and, a second drive shaft, such as shaft 132, for rotating the guide arm. The actuator system includes: a cage actuation assembly including a first motor, such as motor 164, connected to a drive gear, such as gear 166, for the first drive shaft by at least one first gear; and a feed actuation assembly including a second motor, for example, motor 170, at least one second gear, a planetary gear set, such as gear 174, and a drive gear, such as gear 180, for the second drive shaft. The second motor is connected to the planetary gear set by the at least one second gear; the drive gear for the second drive shaft is connected to the planetary gear; and the drive gear for the first drive shaft is connected to the planetary gear. The method includes rotating the drive gear for the first drive shaft to control rotation of the drive gear for the second drive shaft.

In one embodiment, rotating the cage and the guide arm without relative rotation includes: deactivating the second motor; and rotating the second drive gear with the first motor via the planetary gear. In one embodiment, the method includes: actuating the first motor; deactivating the second motor; rotating the first drive shaft at a first rate; and rotating the second drive shaft at second rate, greater than the first rate.

The following is a description of a method for storing, rotating and feeding a high pressure hose. Although the method is depicted as a sequence for clarity, no order should be inferred from the sequence unless explicitly stated. The following should be viewed in light of FIGS. 2-9. One step rotates a cylindrically-shaped cage within a housing. Another step rotates a guide arm, disposed within the cage, such that the guide arm rotates relative to the cage, the guide arm including a plurality of idler rollers forming a guide path. In response to the relative rotation of the guide arm and the cage, the method includes: rotating a portion of a high pressure hose, disposed in the guide path, about a longitudinal axis for the hose, one end of the hose connected to the cage; for relative rotation of the guide arm with respect to the cage in a first rotational direction, urging, with the plurality of idler rollers, the portion of the high pressure hose toward an output port in the housing; and for relative rotation of the guide arm with respect to the cage in a second rotational direction, opposite the first rotational direction, urging, with the plurality of idler rollers, the portion of the high pressure hose away from the output port.

In one embodiment, the method includes rotating the cage and the guide arm at a same rotational rate; rotating the portion of the high pressure hose about the longitudinal axis for the hose; and fixing the portion of the high pressure hose with respect to movement toward or away from the output port.

The following is a description of a method storing, rotating and feeding a high pressure hose. Although the method is depicted as a sequence for clarity, no order should be inferred from the sequence unless explicitly stated. The following should be viewed in light of FIGS. 2-9. A first step engages a first portion of a high pressure hose in a guide path formed by a plurality of idler rollers on a guide arm located in a housing. A second step disposes a second portion of the high pressure hose about a rotatable drum within the housing. A third step rotates the guide arm so that the guide arm and the drum rotate at first and second rates, respectively, the first rate greater than the second rate. In response to the relative rotation of the guide arm and the drum, the method includes: rotating the first portion of the high pressure hose about a longitudinal axis for the hose; for relative rotation of the guide arm with respect to the drum in a first rotational direction, urging, via the plurality of idler rollers, the second portion of the high pressure hose into the guide path and urging a third portion of the high pressure hose through an output port out of the housing; and for relative rotation of the guide arm with respect to the drum in a second rotational direction, opposite the first rotational direction, wrapping, via the plurality of idler rollers, the first portion of the high pressure hose about the drum and urging the third portion of the high pressure hose through the output port into the housing.

In one embodiment, the method includes rotating the guide arm and a cage disposed within the housing so that the guide arm rotates at a same rotational rate as the cage; rotating the first portion of the high pressure hose about the longitudinal axis for the hose; and fixing the third portion of the high pressure hose with respect to movement through the output port.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system for storing, rotating and feeding a high pressure hose, comprising:

a housing including an output port;

a rotatable cylindrically-shaped cage disposed within the housing;

a rotatable cylindrically-shaped drum disposed within the cage;

a rotatable guide arm disposed within the cage; and, an actuator assembly for rotating the cage and the guide arm, wherein:

an end of a high pressure hose is connectable to the cage;

a first portion of the high pressure hose is disposable about the drum;

the guide arm is for engaging a second portion of the high pressure hose; and, the actuator assembly is for rotating the cage and the guide arm, respectively, so that the guide arm rotates relative to the cage such that:

the second portion of the high pressure hose is rotated about a longitudinal axis for the hose;

relative rotation of the guide arm with respect to the cage in a first rotational direction causes the first portion of the high pressure hose to uncoil from the drum and displace along the guide arm and causes a third portion of the high pressure hose in the output port to displace out of the output port away from the guide arm; and, relative rotation of the guide arm with respect to the cage in a second rotational direction, opposite the first rotational direction, causes the second portion of the high pressure hose to coil about the drum and causes the third portion of the high pressure hose to displace into the housing.

2. The system of claim 1 wherein the actuator assembly is for rotating the cage and the guide arm so that the guide arm rotates at a same rotational rate as the cage such that: the second portion of the high pressure hose is rotated about the longitudinal axis for the hose; and, the third portion of the high pressure hose remains fixed with respect to movement through the output port.

3. The system of claim 1 wherein: the guide arm includes a plurality of idler rollers forming a curved guide path from the drum to the output port; the second portion of the high pressure hose is disposed in the guide path; the relative rotation of the guide arm with respect to the cage in the first rotational direction causes a first portion of the plurality of idler rollers to urge the second portion of the high pressure hose through the guide path in a first direction; and, the relative rotation of the guide arm with respect to the cage in the second rotational direction causes a second portion, different from the first portion, of the plurality of idler rollers to urge the second portion of the high pressure hose through the guide path in a second direction opposite the first direction.

4. The system of claim 1 further comprising an axial displacement assembly including a first component connected to the drum and a second component engaged with the first component and connected to the cage, wherein: the guide arm and the drum are axially fixed to each other and axially displaceable; the drum is free to rotate with respect to the guide arm; and, the rotation of the guide arm and the cage causes: relative rotation between the drum and the cage; and, the first component to rotate with respect to the second component, to axially displace the guide arm and the drum.

5. The system of claim 1 wherein: the guide arm includes a plurality of idler rollers having respective axes substantially orthogonal to the axis of rotation for the guide arm and the cage and having respective outer circumferences substantially radially aligned with a second end of the drum; the cage includes an radially inwardly facing surface including a radially inwardly facing protrusion; and, the plurality of idler rollers, the inwardly facing surface, and the inwardly facing protrusion are for restraining the first portion of the high pressure hose as the guide arm rotates with respect to the cage.

6. The system of claim 1 further comprising: a first drive shaft fixedly connected to an end of the cage facing the output port; and, a second drive shaft, co-axial with respect to the first drive shaft and non-rotationally connected to a bridging element that is non-rotationally connected to the guide arm, wherein: the actuator system includes: a cage actuation assembly including a first motor connected to a drive gear for the first drive shaft by a first plurality of reduction gears; and, a feed actuation assembly including a second motor, a planetary gear set, and a drive gear for the second drive shaft, wherein: the second motor is connected to a sun gear for the planetary gear set by a second plurality of reduction gears; the drive gear for the first drive shaft is connected to a ring gear for the planetary gear set; and, the drive gear for the second drive shaft is connected to a plurality of planet gears for the planetary gear set.

7. The system of claim 1 further comprising: a first drive shaft for rotating the cage; and, a second drive shaft for rotating the guide arm, wherein; the actuator system includes: a cage actuation assembly including a first motor connected to a drive gear for the first drive shaft by at least one first gear; and, a feed actuation assembly including a second motor, at least one second gear, a planetary gear set, and a drive gear for the second drive shaft; the second motor is connected to the planetary gear set by the at least one second gear; the drive gear for the second drive shaft is connected to the planetary gear; and, the drive gear for the first drive shaft is connected to the planetary gear set such that rotation of the drive gear for the first drive shaft affects rotation of the drive gear for the second drive shaft.

8. The system of claim 7 wherein to rotate the cage and the guide arm without relative rotation: the second motor is deactivated; and, the first motor rotates the second drive gear via the planetary gear.

9. The system of claim 7 wherein the ratio of the gears in the actuation system is such that when the first motor is actuated and the second motor is deactivated the first and second drive shafts rotate at first and second rates, respectively, the second rate greater than the first rate.

10. A system for storing, rotating and feeding a high pressure hose, comprising:

a housing including an output port;

a rotatable cylindrically-shaped cage disposed within the housing;

a rotatable guide arm disposed within the cage and including a plurality of idler rollers forming a guide path; and, an actuator assembly for rotating the cage and the guide arm, wherein:

a first end of a high pressure hose is connectable to the cage; the guide arm is for engaging a portion of the high pressure hose in the guide path; and, the actuator assembly is for rotating the cage and the guide arm, respectively, so that the guide arm rotates relative to the cage such that:

the portion of the high pressure hose is rotated about a longitudinal axis for the hose;

relative rotation of the guide arm with respect to the cage in a first rotational direction causes the plurality of idler rollers to urge the portion of the high pressure hose toward the output port; and, relative rotation of the guide arm with respect to the cage in a second rotational direction, opposite the first rotational direction, causes the plurality of idler rollers to urge the portion of the high pressure hose away from the output port.

11. The system of claim 10 wherein the actuator assembly is for rotating the cage and the guide arm so that the guide arm rotates at a same rotational rate as the cage such that: the portion of the high pressure hose is rotated about the longitudinal axis for the hose; and, the portion of the high pressure hose is fixed with respect to movement toward or away from the output port.

12. A system for storing, rotating and feeding a high pressure hose, comprising:

a housing with an output port;

a rotatable guide arm including a plurality of idler rollers forming a guide path;

a rotatable drum; and, an actuator assembly for rotating the guide arm, wherein:

the drum is free to rotate relative to the guide arm;

the plurality of idler rollers is for engaging a first portion of a high pressure hose in the guide path;

a second portion of the high pressure hose is disposable about the drum; and, the actuator assembly is for rotating the guide arm relative to the cage such that:

the first portion of the high pressure hose is rotated about a longitudinal axis for the hose; relative rotation of the guide arm with respect to the drum in a first rotational direction causes the plurality of idler rollers to draw the second portion of the high pressure hose into the guide path and to push a third portion of the high pressure hose through the output port of the housing; and, relative rotation of the guide arm with respect to the drum in a second rotational direction, opposite the first rotational direction, causes the plurality of idler rollers to wrap the first portion of the high pressure hose about the drum and to draw the third portion of the high pressure hose through the output port into the housing, further comprising a cage disposed within the housing, wherein the actuator assembly is for rotating the guide arm and the cage at a same rotational rate such that: the first portion of the high pressure hose is rotated about the longitudinal axis for the hose; and, the third portion of the high pressure hose remains fixed with respect to movement through the output port.

13. A method for storing, rotating and feeding a high pressure hose, comprising:

rotating a cylindrically-shaped cage disposed within a housing for a system;

rotating a guide arm disposed within the cage such that the guide arm rotates relative to the cage; and, in response to the relative rotation of the guide arm and the cage:

rotating a first portion of a high pressure hose, engaged with the guide arm, about a longitudinal axis for the hose, wherein an end of the high pressure hose is fixed to the cage;

for relative rotation of the guide arm and the cage in a first rotational direction, uncoiling a second portion of the high pressure hose from about the drum, displacing the first portion of the high pressure hose through the guide arm, and displacing a third portion of the high pressure hose through an outlet port in the housing and out of the housing; and, for relative rotation of the guide arm and the cage in a second rotational direction, opposite the first rotational direction, coiling the first portion of the high pressure hose about a rotatable drum and displacing the third portion of the high pressure hose through the outlet port and into the housing.

14. The method of claim 13 further comprising: rotating the cage and the guide arm at a same rotational rate; rotating the first portion of the high pressure hose about the longitudinal axis for the hose; and, fixing the third portion of the high pressure hose with respect to movement through the output port.

15. The method of claim 13 wherein: the guide arm includes a plurality of idler rollers forming a curved guide path from the drum to the output port; the first portion of the high pressure hose is disposed in the guide path; and, in response to the relative rotation of the guide arm and the cage, urging, with the plurality of idler rollers, the first portion of the high pressure hose through the guide path.

16. The method of claim 13 wherein: the guide arm and the drum are axially fixed to each other and axially displaceable; the drum is free to rotate with respect to the guide arm; and, rotating the guide arm with respect to the cage includes rotating the cage relative to the drum, the method further comprising axially displacing the guide arm and the drum in response to the relative rotation of the cage and the drum.

17. The method of claim 13 wherein: the guide arm includes a plurality of idler rollers having respective axes substantially orthogonal to an axis of rotation for the guide arm and the cage and having respective outer circumferences substantially radially aligned with a second end of the drum; and, the cage includes a radially inwardly facing surface including a radially inwardly facing protrusion, the method further comprising using the plurality of idler rollers, the inwardly facing surface, and the inwardly facing protrusion to restrain the first portion of the high pressure hose as the guide arm rotates with respect to the cage.

18. The method of claim 13 wherein: the system includes: a first drive shaft for rotating the cage; and, a second drive shaft for rotating the guide arm; the actuator system includes: a cage actuation assembly including a first motor connected to a drive gear for the first drive shaft by at least one first gear; and, a feed actuation assembly including a second motor, at least one second gear, a planetary gear set, and a drive gear for the second drive shaft; the second motor is connected to the planetary gear set by the at least one second gear; the drive gear for the second drive shaft is connected to the planetary gear; and, the drive gear for the first drive shaft is connected to the planetary gear, the method further comprising rotating the drive gear for the first drive shaft to control rotation of the drive gear for the second drive shaft.

19. The method of claim 18 wherein rotating the cage and the guide arm without relative rotation includes: deactivating the second motor; and, rotating the second drive gear with the first motor via the planetary gear.

20. The method of claim 18 further comprising: actuating the first motor; deactivating the second motor; rotating the first drive shaft at a first rate; and, rotating the second drive shaft at second rate, greater than the first rate.

21. A method for storing, rotating and feeding a high pressure hose, comprising:

rotating a cylindrically-shaped cage within a housing; rotating a guide arm, disposed within the cage, such that the guide arm rotates relative to the cage, the guide arm including a plurality of idler rollers forming a guide path; and, in response to the relative rotation of the guide arm and the cage:

rotating a portion of a high pressure hose, disposed in the guide path, about a longitudinal axis for the hose, wherein one end of the hose is connected to the cage; for relative rotation of the guide arm with respect to the cage in a first rotational direction, urging, with the plurality of idler rollers, the portion of the high pressure hose toward an output port in the housing; and, for relative rotation of the guide arm with respect to the cage in a second rotational direction, opposite the first rotational direction, urging, with the plurality of idler rollers, the portion of the high pressure hose away from the output port.

22. The method of claim 21 further comprising: rotating the cage and the guide arm at a same rotational rate; rotating the portion of the high pressure hose about the longitudinal axis for the hose; and, fixing the portion of the high pressure hose with respect to movement toward or away from the output port.

23. A method for storing, rotating and feeding a high pressure hose, comprising:

engaging a first portion of a high pressure hose in a guide path formed by a plurality of idler rollers on a guide arm located in a housing;

disposing a second portion of the high pressure hose about a rotatable drum within the housing;

rotating the guide arm so that the guide arm rotates with respect to the drum rotate at first and second rates, respectively, the first rate greater than the second rate; and, in response to the relative rotation of the guide arm and the drum:

rotating the first portion of the high pressure hose about a longitudinal axis for the hose;

for relative rotation of the guide arm with respect to the drum in a first rotational direction, urging, via the plurality of idler rollers, the second portion of the high pressure hose into the guide path and feeding a third portion of the high pressure hose through an output port out of the housing; and, for relative rotation of the guide arm with respect to the drum in a second rotational direction, opposite the first rotational direction, wrapping, via the plurality of idler rollers, the first portion of the high pressure hose about the drum and urging the third portion of the high pressure hose through the output port into the housing further comprising: rotating the guide arm and a cage disposed within the housing so that the guide arm rotates at a same rotational rate as the cage; rotating the first portion of the high pressure hose about the longitudinal axis for the hose; and, fixing the third portion of the high pressure hose with respect to movement through the output port.

* * * * *

UNITED STATES PATENT AND TRADEMARK OFFICE

CERTIFICATE OF CORRECTION

PATENT NO. : 8,505,845 B2
APPLICATION NO. : 12/846531
DATED : August 13, 2013
INVENTOR(S) : Zink It is certified that error appears in the above-identified patent and that said Letters Patent is hereby corrected as shown below:

In the Specification

In Column 8, Line 59, delete "arm 108," and insert -- arm 110, --.

In the Claims

In Column 12, Line 32, in Claim 7, delete "wherein;" and insert -- wherein: --.

Signed and Sealed this
Fifteenth Day of April, 2014

Michelle K. Lee

Michelle K. Lee
*Deputy Director of the United States Patent and Trademark Office*